United States Patent [19]

Sahar

[11] 4,453,342

[45] Jun. 12, 1984

[54] BATTERY OPERATED SPINNING TOP

[76] Inventor: Raphael Sahar, 2 King David St., Tiberias, Israel

[21] Appl. No.: 269,971

[22] Filed: Jun. 3, 1981

[51] Int. Cl.[3] ..... A63H 1/00

[52] U.S. Cl. ..... 446/37

[58] Field of Search ..... 46/269, 64, 67, 82, 46/74 R, 248

[56] References Cited

U.S. PATENT DOCUMENTS

| | | | |
|---|---|---|---|
| 3,019,555 | 2/1962 | Poticha | 46/269 |
| 3,533,187 | 10/1970 | Campbell | 46/269 |
| 4,233,774 | 11/1980 | Sahar | 46/82 |

FOREIGN PATENT DOCUMENTS

| | | | |
|---|---|---|---|
| 1009079 | 5/1957 | Fed. Rep. of Germany | 46/269 |

*Primary Examiner*—Robert Peshock
*Assistant Examiner*—Mickey Yu
*Attorney, Agent, or Firm*—Toren, McGeady & Stanger

[57] ABSTRACT

A spinning top comprises a casing of pear shaped appearance. From the lower (pointed) end of the casing extends a stem which is springily urged out of the casing and which - when hit by a racket - moves inwardly, and closes the circuit of a small electrical motor (fed with current by dry batteries within the casing). The motor sets into rotative movement a propeller, the shaft of which extends out of the casing.

2 Claims, 2 Drawing Figures

BATTERY OPERATED SPINNING TOP

FIELD OF INVENTION

The invention relates to a plaything, more particularly to a spinning top of the kind described in my earlier U.S. Pat. Nos. 4,202,133 and 4,233,774. However, while in the said construction a propeller at the top of the spinning top is set into rotative motion by dropping the top to the ground, in the present construction electrical means are provided within the top, i.e. a small motor and one or two dry batteries supplying current to the motor. The top according to the present invention is made to rise into the air by hitting it by means of a racket of the kind used in ping pong playing.

SHORT SUMMARY OF DISCLOSURE

There is provided according to the invention a pear shaped casing —constituting the spinning top, in the upper portion (i.e. the wide one in position of play) is provided a small electrical motor the shaft of which extends out of the casing in the axial direction of the latter, a propeller being keyed at the free end of the shaft, a lengthwise split tubular member of conductive material being positioned axially within the casing, the two halves of the said split tubular member being each connected in a closable circuit with the poles of the motor via a source of current within the casing, a stem which is urged outwardly from the casing and is positioned co-linearly with the said split tubular member being provided, the said stem having a metallic member at its inner end a resilient sphere at its outer end, so that when the stem is urged inwardly of the casing, the said metallic member is made to contact the two halves of the said tubular, split member and close the circuit, so actuating the motor and setting the propeller into rotative movement.

SHORT DESCRIPTION OF DRAWINGS

FIG. 1 is an axial section of the new spinning top, showing schematically the electrical drive, and FIG. 2 is a section on line II-II of FIG. 1.

DESCRIPTION OF PREFERRED EMBODIMENT

Figure 1:
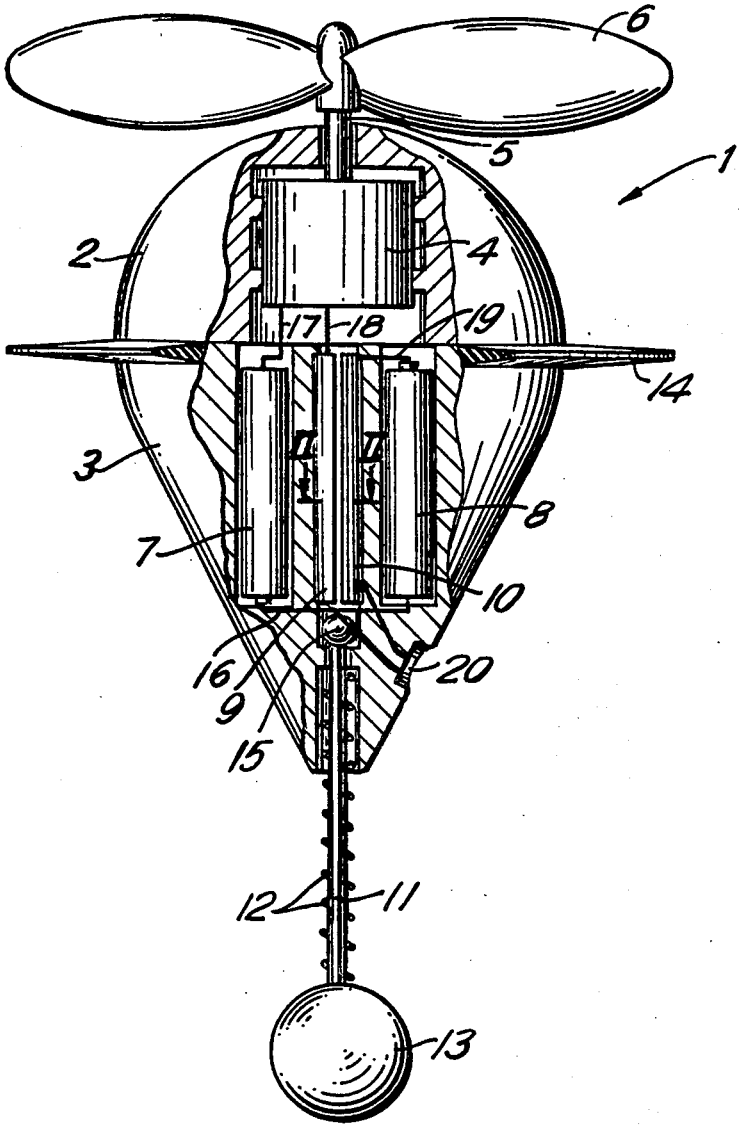
Figure 2:
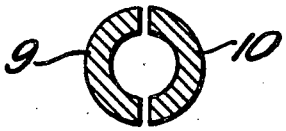

The casing, or the body of the spinning top which is designated as a whole by the numeral 1 is assembled from two parts 2 and 3 which are joined together at their widest portions. In the upper part is positioned a small electromotor 4, the shaft 5 of which extends upwardly into the open. A propeller 6 is keyed to the shaft 5. Below the motor 4 are located two dry batteries 7 and 8. A lengthwise split tube consisting of two halves 9 and 10 of semicircular profile (see FIG. 2) is fixedly held a short distance below the motor 4. The two halves 9 and 10 do not contact one another. They are made of electrically conductive material, say copper. There is slidingly held, colinearly with members 9-10 a stem 11 which extends downwardly from the body 1. A spiral spring 12 urges the stem outwardly of body 1. At the free end of stem 11 is affixed to it a sphere 13 of resilient material.

At the widest portion of body 1 (i.e. at the junction of the two parts 2 and 3) there is provided a flat ring 14 of resilient material. At the top of stem 11 is held a small sphere of conductive material.

The electric connections in the new top are as follows:

The two batteries 7 and 8 are interconnected by a conduit 16. From battery 7 leads a wire 17 to one pole of the motor, while a second wire 18 connects the other pole of motor 4 with the member 9. From member 10 a wire leads to battery 8. Thus a closable circuit is established from battery 7, wire 17, motor 4, wire 18, member 9. From member 10 the wire 19 leads to battery 8. The circuit can be closed by bridging the gap between the two semicircular members 9 and 10 which can be effected by means of sphere 15 which can either just touch the ends of the two members or can enter the circular space defined by them.

The new plaything is used in the following manner: By means of a ping-pong racket and after having thrown the top into the air, it is hit at the sphere 13. According to the force of the stroke the sphere 15 touches the two semicircular members 9 and 10 or penetrates into the gap between them, closing the circuit. Under bias of the spring 12, the stem 11 slides outwardly and dependent on the depth of its penetration into the body 1 it will take a longer or shorter time until contact by sphere 15 is broken. During all the time that the circuit is closed, the propeller rotates and causes the top to hover and return slowly to earth.

Damage to the propeller is prevented - when the top drops to the ground, by the ring 14 the diameter of which is somewhat larger than the disc of the propeller.

There may be provided a switch 20 by means of which the circuit can be permanently closed.

I claim:

1. A battery actuated spinning top comprising a pear shaped casing in the widest portion of which is provided a small electrical motor the shaft of which extends out of the casing in the axial direction of the latter, a propeller being keyed at the free end of the shaft, a lengthwise split tubular member of conductive material being positioned axially within the casing, the two halves of the said split tubular member being each connected in a closable circuit with the poles of the motor via a source of current within the casing, a stem which is urged outwardly from the casing and is positioned co-linearly with the said split tubular member is being provided, the said stem having a metallic member at its inner end and a resilient sphere at its outer end, so that when the stem is urged inwardly of the casing, the said metallic member is made to contact the two halves of the split tubular member and close the circuit, so actuating the motor and setting the propeller into rotative movement.

2. The top claimed in claim 1 characterised thereby that the source of current is constituted by two interconnected flashlight batteries.

* * * * *